US012480273B2

(12) United States Patent
Kim

(10) Patent No.: US 12,480,273 B2
(45) Date of Patent: Nov. 25, 2025

(54) UNDERWATER CONCRETE BLOCK STRUCTURE AND CONSTRUCTION METHOD THEREFOR

(71) Applicant: YUJOO CO., LTD., Busan (KR)

(72) Inventor: Sangki Kim, Busan (KR)

(73) Assignee: YUJOO CO., LTD., Busan (KR)

( * ) Notice: Subject to any disclaimer, the term of this patent is extended or adjusted under 35 U.S.C. 154(b) by 273 days.

(21) Appl. No.: 18/235,143

(22) Filed: Aug. 17, 2023

(65) Prior Publication Data

US 2023/0392341 A1 Dec. 7, 2023

Related U.S. Application Data

(63) Continuation of application No. PCT/KR2022/002076, filed on Feb. 11, 2022.

(30) Foreign Application Priority Data

Feb. 25, 2021 (KR) ..... 10-2021-0025363

(51) Int. Cl.
*E02D 27/52* (2006.01)
*E02D 25/00* (2006.01)

(52) U.S. Cl.
CPC ..... *E02D 25/00* (2013.01); *E02D 2250/0061* (2013.01); *E02D 2600/20* (2013.01)

(58) Field of Classification Search
CPC ..... E02D 13/04; E02D 25/00; E02D 27/52; E02D 29/025; E02B 3/04; E02B 3/06; E02B 3/066
See application file for complete search history.

(56) References Cited

U.S. PATENT DOCUMENTS 5,507,127 A * 4/1996 Gates ..... E04C 1/40 52/DIG. 9

FOREIGN PATENT DOCUMENTS

| | | | |
|---|---|---|---|
| JP | 2012-251292 | A | 12/2012 |
| KR | 10-2011-0116262 | A | 10/2011 |
| KR | 10-1355805 | B1 | 1/2014 |
| KR | 10-1746097 | B1 | 6/2017 |
| KR | 10-2022339 | B1 | 9/2019 |
| KR | 10-2191675 | B1 | 12/2020 |

OTHER PUBLICATIONS

International Search Report for PCT/KR2022/002076 mailed May 18, 2022 from Korean Intellectual Property Office.
Korean Office Action for related KR Application No. 10-2021-0025363 mailed Jul. 6, 2021 from Korean Intellectual Property Office.
Korean Office Action for related KR Application No. 10-2021-0025363 mailed Oct. 21, 2021 from Korean Intellectual Property Office.

* cited by examiner

*Primary Examiner* — Sean D Andrish
(74) *Attorney, Agent, or Firm* — Paratus Law Group, PLLC

(57) ABSTRACT

A constructing method of an underwater concrete block structure, includes: a first concrete block fabrication step, a guide pole installation step, a first concrete block installation step, a second concrete block fabrication step, a second concrete block installation step, a drainage step, a guide pole removal step, and a concrete column formation step. A concrete column and a first concrete block is firmly coupled to each other via a column rebar assembly.

5 Claims, 17 Drawing Sheets

UNDERWATER CONCRETE BLOCK STRUCTURE AND CONSTRUCTION METHOD THEREFOR

CROSS-REFERENCE TO PRIOR APPLICATIONS

This application is a Continuation Application of PCT International Application No. PCT/KR2022/002076 (filed on Feb. 11, 2022), which claims priority to Korean Patent Application No. 10-2021-0025363 (filed on Feb. 25, 2021), which are all hereby incorporated by reference in their entirety.

BACKGROUND

The present invention relates to an underwater concrete block structure installed at sea or in a river for various purposes such as docks for a port, coastal wave absorbing revetment or breakwater, etc. and a method of constructing an underwater concrete block structure.

Generally, an underwater concrete block structure, such as docks for a port, coastal wave absorbing revetment or breakwater, etc., is installed underwater for various purposes. The underwater structure refers to a structure that is installed underwater so that the upper portion thereof is located above or below the water surface.

A widely known construction technique for the construction of underwater structures is a large caisson method. While the large caisson method has the advantage of being able to withstand big waves, the large caisson method also has the disadvantage of requiring high costs for transportation and construction and having various constraints, since the large caisson which is very huge structure needs to be fabricated on land, transported to the installation point, and installed in the water.

In order to solve the problem of the large caisson method, a method of forming an underwater structure by stacking small concrete blocks in multiple layers according to the water depth is known.

The inventor's Korean Patent No. 10-1355805 (registered on Jan. 15, 2014) entitled "Underwater Concrete Block Structure and Construction Method thereof" discloses a technique in which a concrete column is formed in a waterproof membrane and an upper concrete block and a lower concrete block are coupled together in a structural integrity by concrete columns, thereby having sufficient structural stability even in the waves caused by large typhoons.

The present disclosure is proposed to further improve the prior art.

SUMMARY

The present disclosure has been made to solve the above problem occurring in the prior art and is intended to propose an underwater concrete block structure in which there is no need to use a waterproof membrane, and a concrete column and a first concrete block can be firmly coupled via a column rebar assembly, and a construction method therefor.

In order to accomplish the above objectives, the present disclosure provides a method of constructing an underwater concrete block structure, the method includes: a first concrete block fabrication step of fabricating a first concrete block comprising a first concrete block body, a column rebar assembly which extends vertically upward from a lower end part thereof connected to the inside of the first concrete block body and protrudes upward from the upper surface of the first concrete block body, and a first watertight packing disposed on the upper surface of the first concrete block body in a form surrounding the column rebar assembly; a guide pole installation step of installing a guide pole on the first concrete block after the first concrete block fabrication step, wherein the guide pole comprises a guide pipe having a shape of a pipe extending vertically to insert the column rebar assembly along the inside of the guide pipe and a upper insertion guide part formed at the upper end of the guide pipe and having an upwardly tapered shape; a first concrete block installation step of installing the first concrete block underwater after the guide pole installation step; a second concrete block fabrication step of fabricating a second concrete block comprising a second concrete block body having a through hole extending vertically; a second concrete block installation step of installing the second concrete block such that a concrete block assembly is formed by installing the second concrete block on the first concrete block so that the guide pole is inserted into the through hole of the second concrete block after the second concrete block fabrication step and the first concrete block installation step, wherein a concrete-column through hole having a closed lower end is formed in the concrete block assembly by the through hole of the second concrete block and the first concrete block, and the first watertight packing is located between the first concrete block and the second concrete block to prevent water from being introduced into the concrete-column through hole from the outside; a drainage step of removing water contained inside the concrete-column through hole after the second concrete block installation step; a guide pole removal step of removing the guide pole after the drainage step; and a concrete column formation step of forming a concrete column by pouring concrete into the concrete-column through hole after the drainage step, wherein the concrete column comprises the column rebar assembly and the poured concrete integrated with each other and is coupled to the first concrete block body via the column rebar assembly.

In the above, the column rebar assembly may have a length to pass through the concrete-column through hole and protrudes from the top of the concrete-column through hole, and a cap concrete formation step of forming a cap concrete on the concrete block assembly after the concrete column formation step so that an upper end of the column rebar assembly is connected to the inside of the cap concrete may be comprised.

In the above, a block-side coupler may be provided in the first concrete block body in a form surrounding the column rebar assembly, the guide pole may comprise a pipe-side coupler at a lower end part of the guide pipe to be coupled detachably to the block-side coupler and a third watertight packing provided on the lower end part of the guide pipe to prevent water from being introduced into the inside of the guide pipe from the outside by being in close contact with the first concrete block, and at the guide pole installation step, the pipe-side coupler of the guide pole may be coupled detachably to the block-side coupler of the first concrete block.

In the above, a drain pipe of which a lower end communicates with the outside through a drain hole formed in the lower end part of the guide pipe may extend vertically inside the guide pole, the water contained inside the concrete-column hole may be removed using the drain pipe at the drainage step, and the guide pole removal step may be performed after the drainage step.

In the above, a second watertight packing may be disposed on an upper surface of the second concrete block body in a form surrounding the through hole; and at the second concrete block installation step, a plurality of second concrete blocks may be installed in multiple layers on the first concrete block, and the second watertight packing may be located between the second concrete blocks installed to be vertically adjacent to each other so that water is prevented from being introduced into the concrete-column through hole from the outside.

As described above, the present disclosure does not need a waterproof membrane, the concrete column can be formed in the same way as the land environment, and the concrete column and the first concrete block can be coupled more firmly via the column rebar assembly.

DETAILED DESCRIPTION

Figure 1:
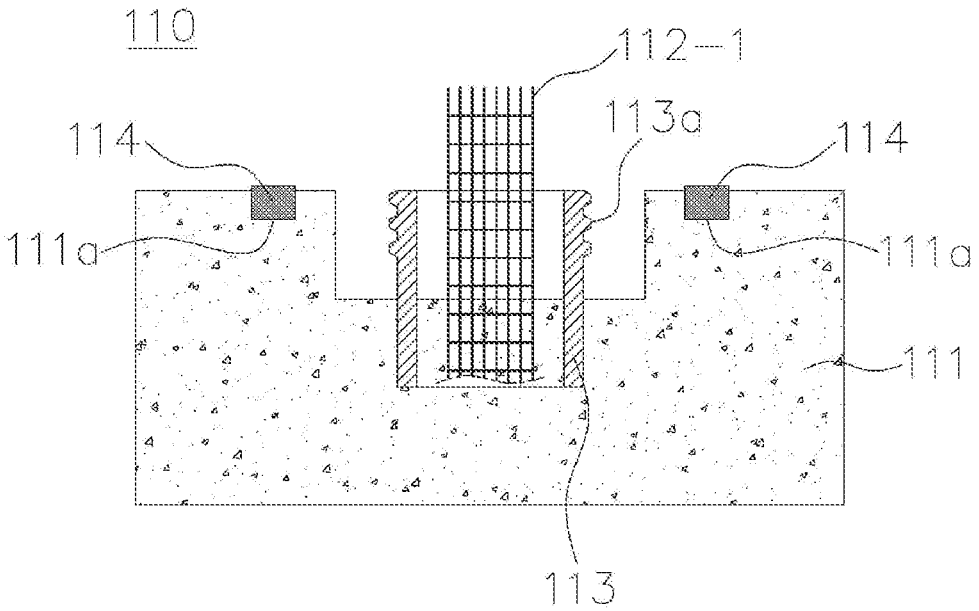
FIGS. 1 to 9 are views sequentially illustrating a method of constructing an underwater concrete block structure according to a first embodiment of the present disclosure.

Hereinafter, embodiments of the present disclosure will be described in detail with reference to the accompanying drawings so that those skilled in the art to which the present disclosure belongs can easily embody the present disclosure. However, the present disclosure may be embodied in various different forms and is not limited to the embodiments described herein. In addition, in the drawings, parts irrelevant to the description of the present disclosure are omitted in order to clearly describe the present disclosure, and similar reference numerals are assigned to similar parts throughout the specification.

Throughout the specification, when a part "includes" a certain component, it means that other components may be further included without being excluded unless specifically stated to the contrary.

First, a method of constructing an underwater concrete block structure according to a first embodiment of the present disclosure will be described.

Figure 2:
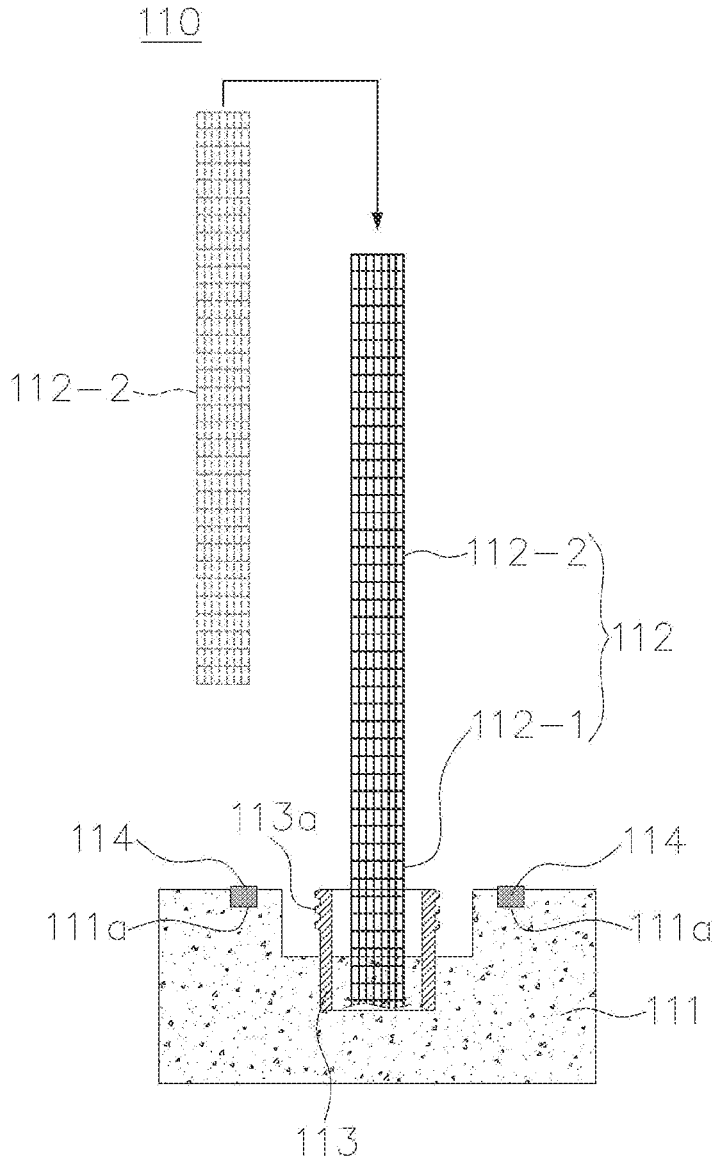
Figure 3:
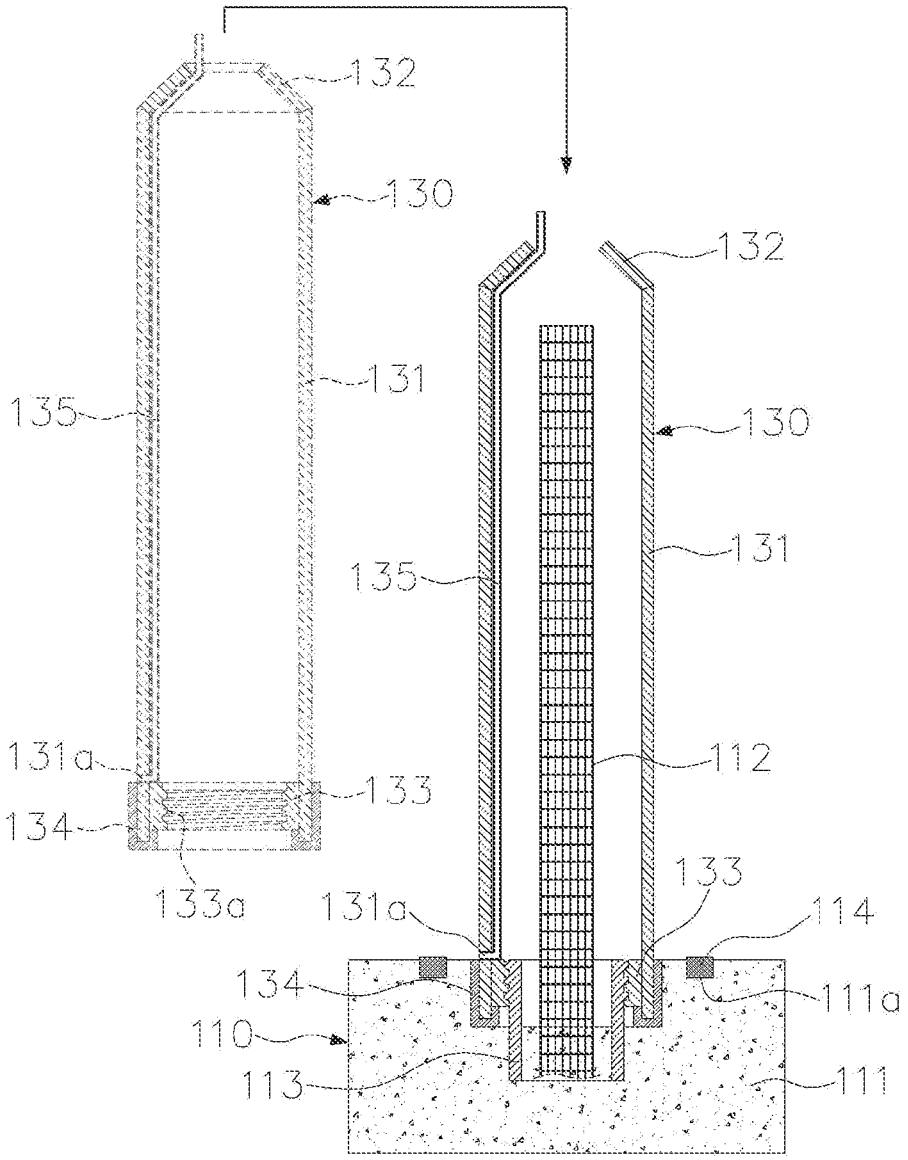
Figure 4:
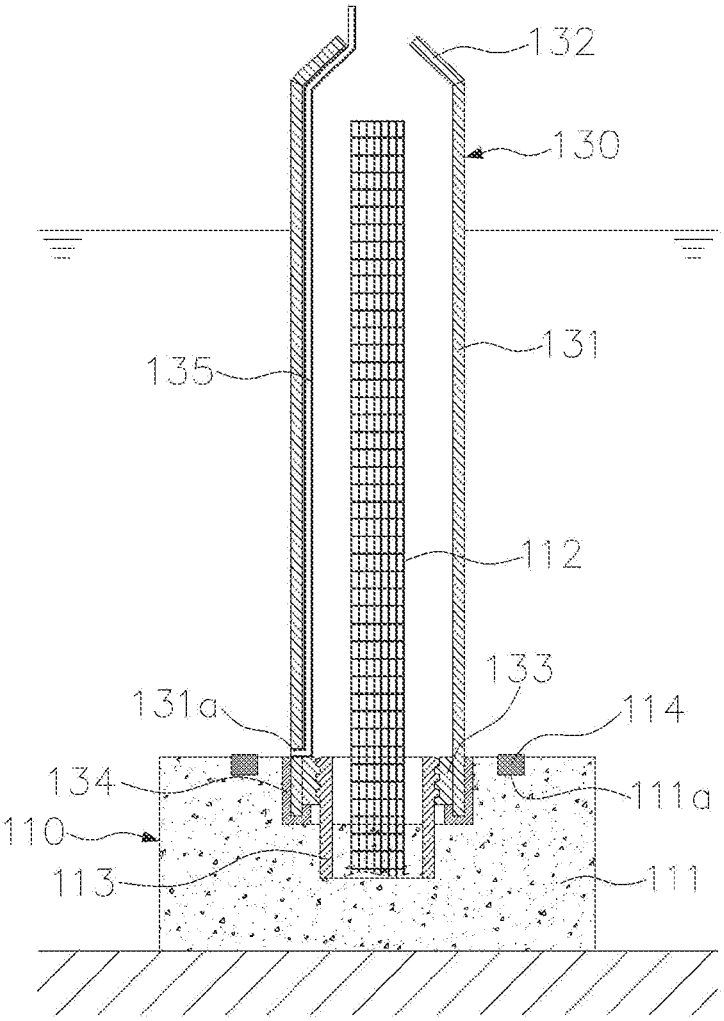
Figure 5:
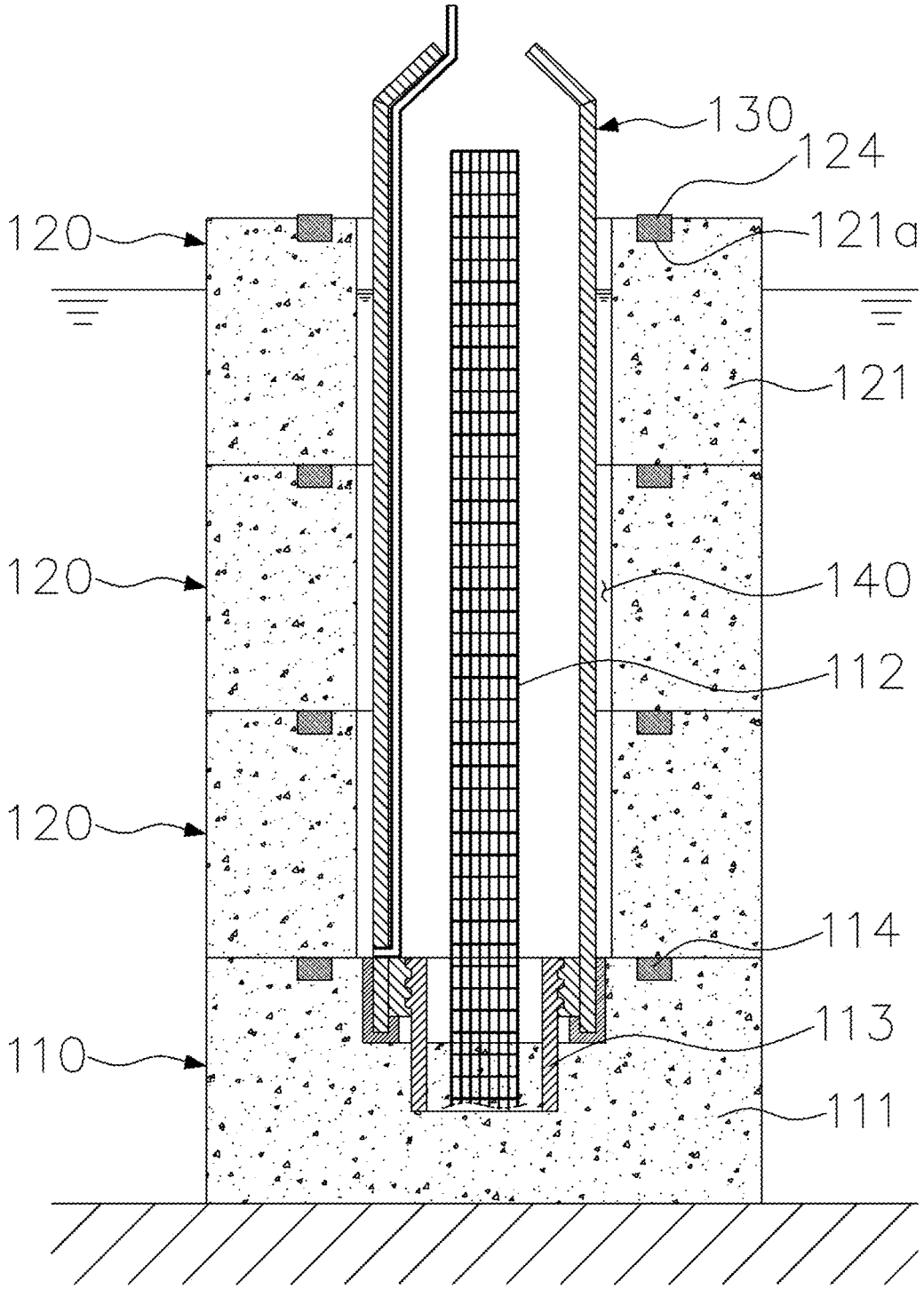
Figure 8:
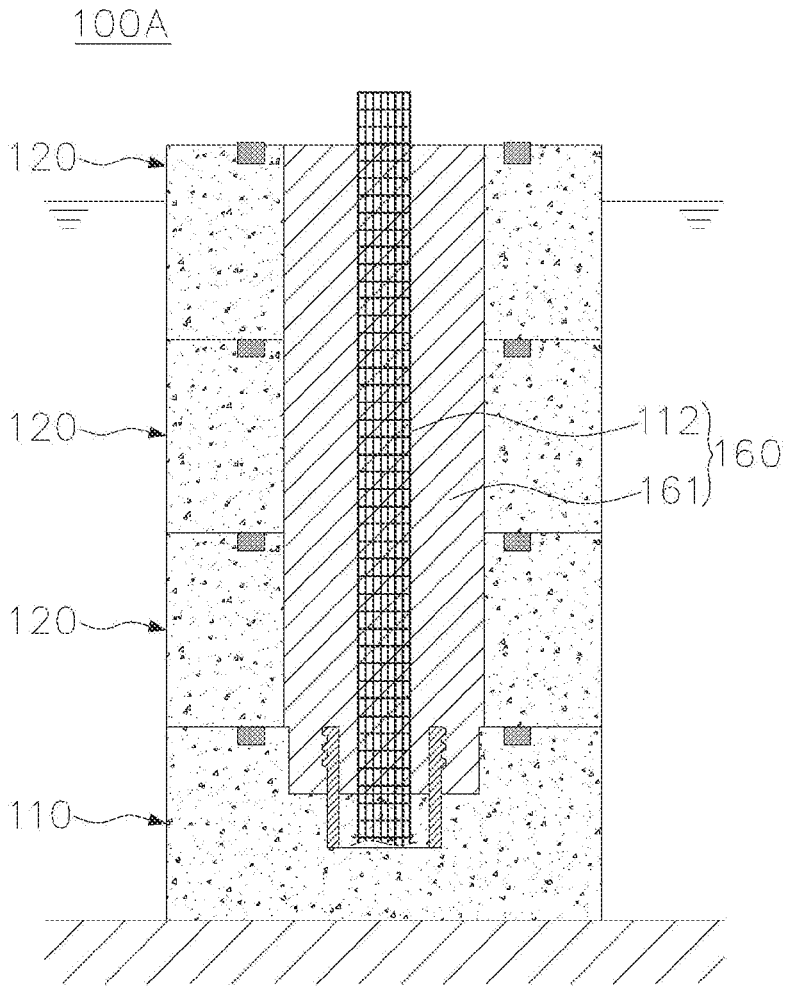
Figure 9:
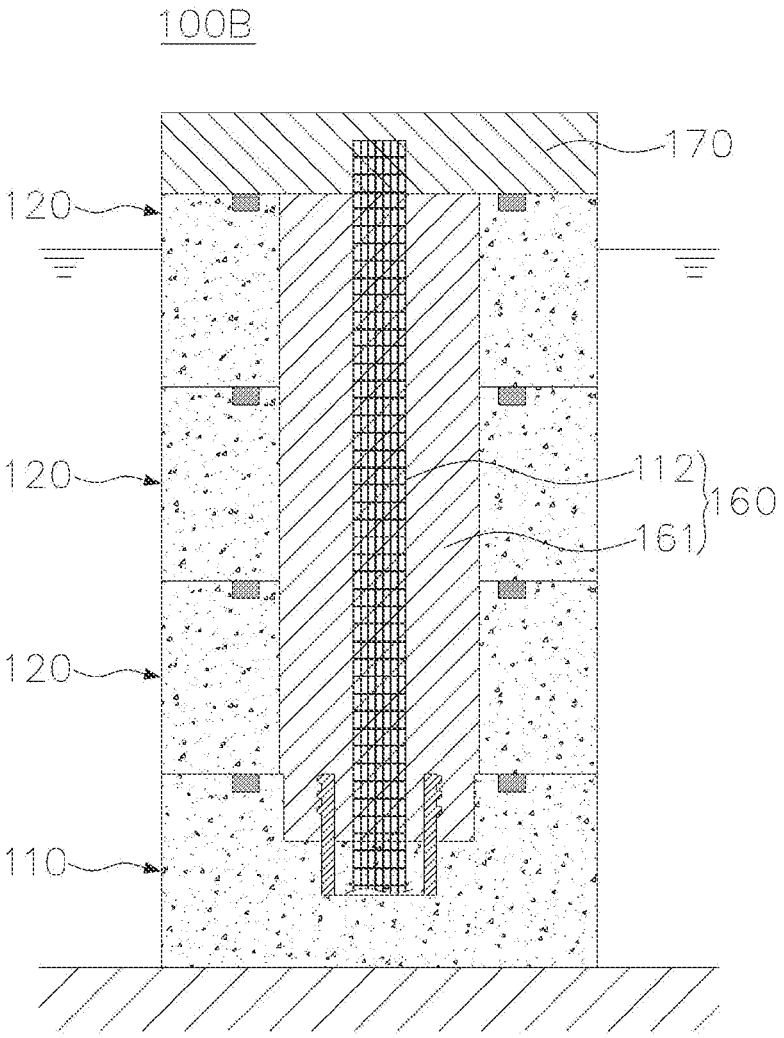
Figure 10:
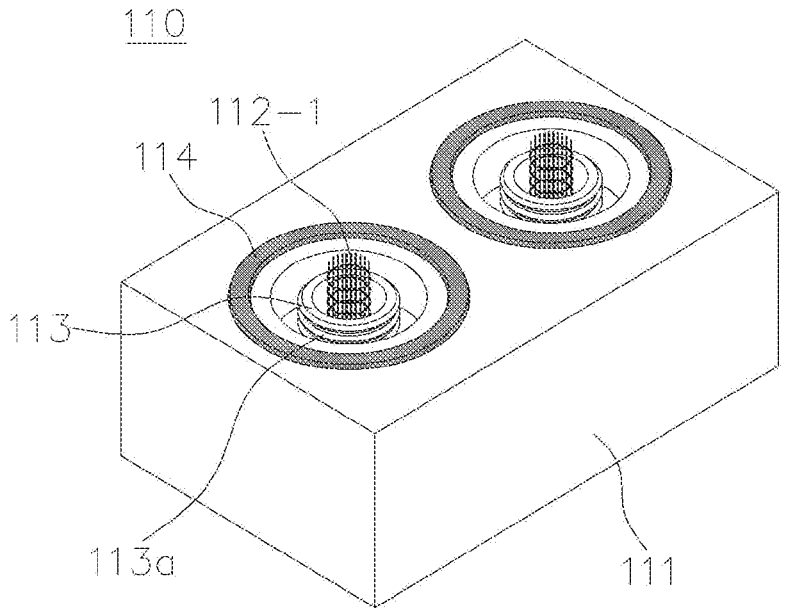
FIG. 10 is a perspective view of a first concrete block in FIG. 1.
Figure 11:
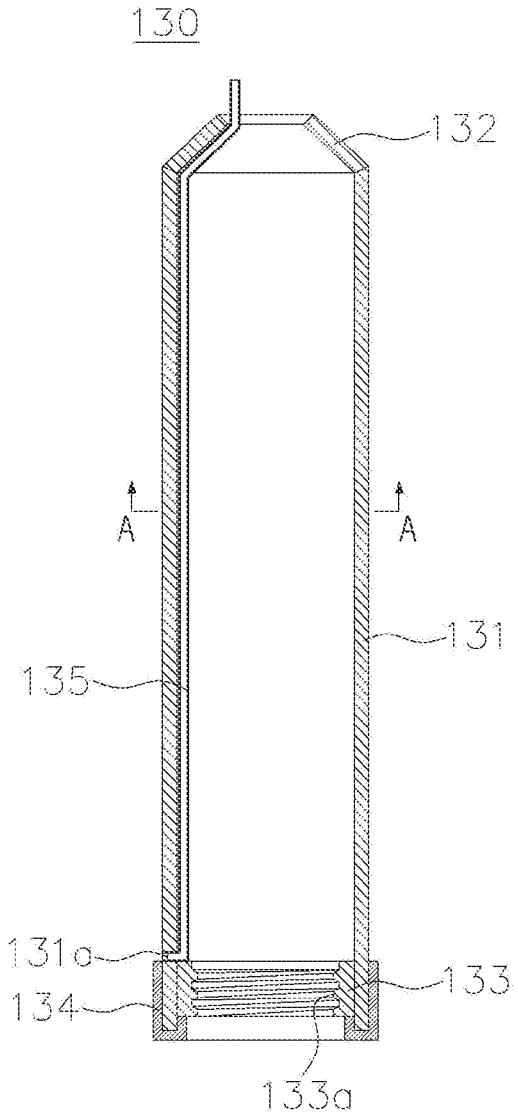
FIG. 11 is a sectional view of a guide pole in FIG. 3.
Figure 12:
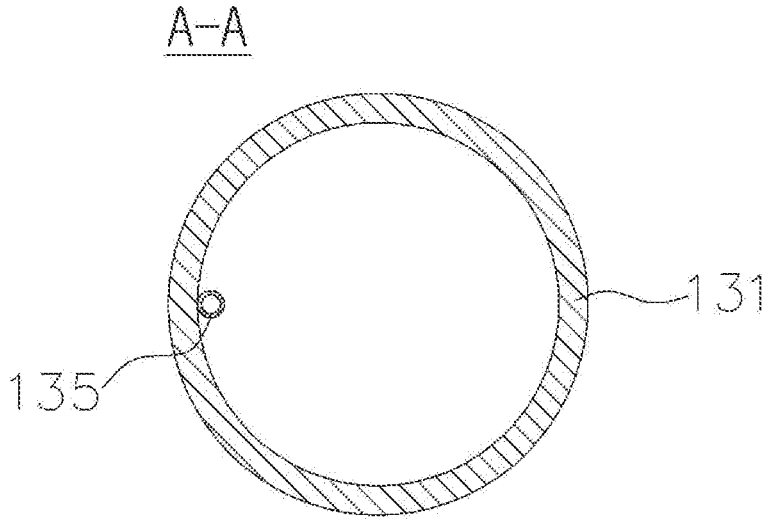
FIG. 12 is a sectional view taken along the A-A line of FIG. 11.
Figure 13:
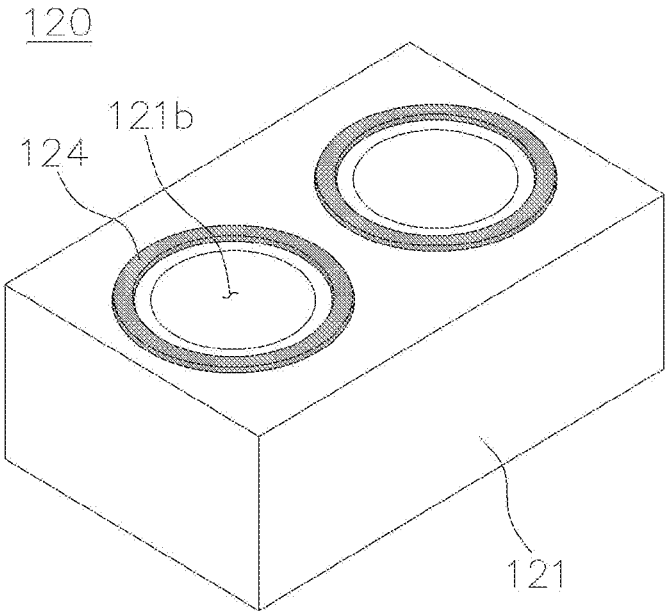
FIG. 13 is a perspective view of a second concrete block in FIG. 5.
Figure 14:
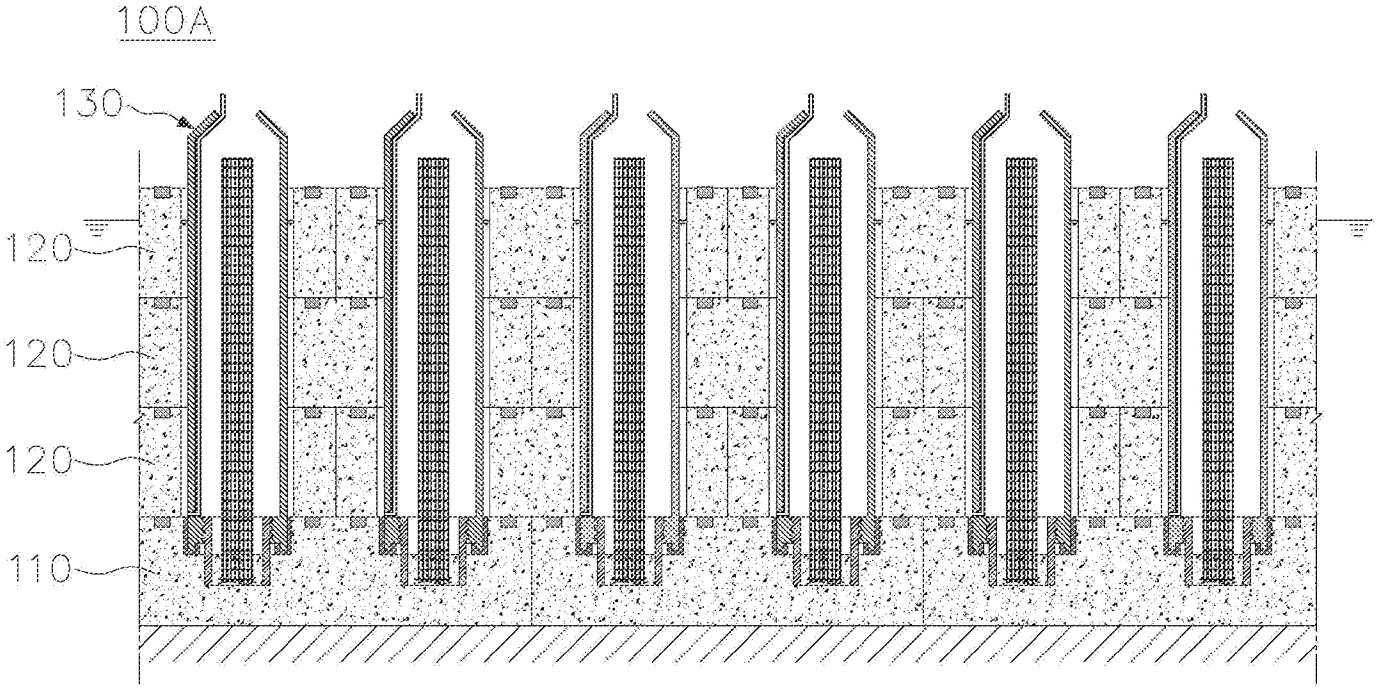
FIG. 14 is a sectional view showing the plurality of concrete block assemblies of FIG. 5 continuously disposed horizontally.

FIGS. 1 to 9 are views sequentially illustrating a method of constructing an underwater concrete block structure according to a first embodiment of the present disclosure, FIG. 10 is a perspective view of a first concrete block in FIG. 1, FIG. 11 is a sectional view of a guide pole in FIG. 3, FIG. 12 is a sectional view taken along the A-A line of FIG. 11, FIG. 13 is a perspective view of a second concrete block in FIG. 5, FIG. 14 is a sectional view showing the plurality of concrete block assemblies of FIG. 5 continuously disposed horizontally.

(1) First Concrete Block Fabrication Step

In this embodiment a first concrete block fabrication step is performed in the order of FIG. 1 and FIG. 2.

First, as illustrated in FIGS. 1 and 10, the first concrete block 110 is fabricated in first.

The first concrete block 110 includes a first concrete block body 111 having a cuboid shape, as illustrated in FIG. 10.

The first concrete block body 111 is provided with a preliminary rebar assembly 112-1, a block-side coupler 113, and a first watertight packing 114.

In this embodiment, two preliminary rebar assemblies 112-1 are provided, and a block-side coupler 113 and a first watertight packing 114 are provided for each of the preliminary rebar assemblies 112-1.

Each of the preliminary rebar assemblies 112-1 has a lower end part connected to the inside of the first concrete block body 111 (specifically, the inner reinforcing bar of the first concrete block body 111) and extends vertically upward from the lower end part to protrude upward from the upper surface of the first concrete block body 111.

As illustrated in FIG. 2, an extension rebar assembly 112-2 is connected to the preliminary rebar assembly 112-1, and thus the preliminary rebar assembly 112-1 and the extension rebar assembly 112-2 together constitute the column rebar assembly 112.

The block-side coupler 113 is provided in a form surrounding the preliminary rebar assembly 112-1.

In this embodiment, the block-side coupler 113 has a form of a pipe and the preliminary rebar assembly 112-1 is disposed therein and male threads 113*a* are formed on an outer circumferential surface thereof.

A first packing groove 111*a* is formed on the upper surface of the first concrete block body 111, and a first watertight packing 114 is provided in the first packing groove 111*a*.

The first packing groove 111*a* and the first watertight packing 114 are formed in the form of a ring surrounding the preliminary rebar assembly 112-1.

After fabricating the first concrete block 110 as illustrated in FIG. 1, the extension rebar assembly 112-2 is connected to the preliminary rebar assembly 112-1 as illustrated in FIG. 2, and the fabrication of the first concrete block 110 is completed.

Accordingly, the first concrete block 110 includes the first concrete block body 111, the column rebar assembly 112, the block-side coupler 113, and the first watertight packing 114.

(2) Guide Pole Installation Step

After the first concrete block fabrication step, as illustrated in FIG. 3, the guide pole 130 is detachably coupled to the block-side coupler 113 of the first concrete block 110.

As illustrated in FIGS. 11 and 12, the guide pole 130 includes a guide pipe 131, an upper insertion guide part 132, a pipe-side coupler 133, a third watertight packing 134, and a drain pipe 135.

The guide pipe 131, which has a shape of a pipe extending in a vertical direction, has a hollow extending in the vertical direction formed along the inside thereof and is open in the upper and lower parts thereof.

Accordingly, the column rebar assembly 112 may be inserted along the inside of the guide pipe 131.

The guide pipe 131 has a drain hole 131*a* formed at a lower end part thereof.

The upper insertion guide part 132 is formed at the upper end of the guide pipe 131 and has an upwardly tapered shape.

The upper insertion guide part 132 is intended to be a guide for installing a second concrete block 120 to be described later.

The pipe-side coupler 133 is provided on the inner circumferential surface of the lower end part of the guide pipe 131 and is detachably coupled to the block-side coupler 113 of the first concrete block 110.

To this end, female threads 133*a* are formed in the pipe-side coupler 133 so as to be screwed to the male threads 113*a* of the block-side coupler 113.

In this embodiment, although the pipe-side coupler 133 and the block-side coupler 113 are exemplified by screw coupling in order to be detachably coupled, the detachable coupling structure may be applied in a variety of ways.

The third watertight packing 134 is provided on the lower end part of the guide pipe 131, and when the guide pole 130 is coupled to the block-side coupler 113, that is, when the pipe-side coupler 133 is screwed to the block-side coupler 113, water is prevented from being introduced into the guide pipe 131 from the outside.

When the pipe-side coupler 133 of the guide pole 130 is screwed to the block-side coupler 113, the third watertight packing 134 is in close contact with the first concrete block 110, so water can be prevented from being introduced into the guide pipe 131.

The drain pipe 135 is a tube extending vertically inside the guide pole 130, and the lower end of the drain pipe 135 communicates with the outside through the drain hole 131*a* formed in the lower end part of the guide pipe 131, and the upper end of the drain pipe 135 extends up to the upper end part of the guide pole 130.

In this embodiment, the drain pipe 135 is in close contact with the inner circumferential surface of the guide pipe 131 and extends in the vertical direction.

The first concrete block 110 can be installed underwater after the guide pole 130 is coupled to the block-side coupler 113 on land as illustrated in FIG. 3.

In some cases, the guide pole 130 may be simply mounted on the top of the first concrete block 110, and in this case, the guide pole installation step may be performed after the first concrete block installation step.

(3) First Concrete Block Installation Step

After the guide pole 130 is installed on the first concrete block 110 as illustrated in FIG. 3, the first concrete block 110 is installed underwater as illustrated in FIG. 4.

As illustrated in FIG. 4, the third watertight packing 134 is in close contact with the first concrete block 110 and prevents water from being introduced into the guide pole 130.

Furthermore, the upper end of the guide pole 130 protrudes from a water surface.

Accordingly, in this embodiment, the column rebar assembly 112 is not in contact with seawater by the guide pole 130. Accordingly, the column rebar assembly 112 has no risk of corrosion due to contact with seawater.

(4) Second Concrete Block Fabrication Step

A second concrete block 120 is fabricated.

The second concrete block 120 includes a second concrete block body 121 which has a cuboid shape and two through holes 121*b* extending vertically as illustrated in FIG. 13.

The through hole 121*b* has a diameter larger than the diameter of the guide pipe 131.

A second watertight packing 124 is provided in each of the through holes 121*b* of the second concrete block body 121.

Second packing grooves 121*a* are formed on the upper surface of the second concrete block body 121, and the second watertight packing 124 is provided in each of the second packing grooves 121*a*.

The second packing groove 121*a* and the second watertight packing 124 are formed in the form of a ring surrounding the through hole 121*b*.

(5) Second Concrete Block Installation Step

After the second concrete block fabrication step and the first concrete block installation step, as illustrated in FIG. 5, the second concrete blocks 120 are installed on the top of the first concrete block 110, and thus the concrete block assembly 100A is formed.

As illustrated in FIG. 4, the second concrete blocks 120 are installed so that the column rebar assemblies 112 of the first concrete block 110 installed underwater are inserted into the through holes 121*b* of the second concrete blocks 120.

More specifically, the second concrete block 120 is lowered from the upper side to the lower side so that the guide pole 130 installed in the first concrete block 110 is inserted into the through hole 121*b* of the second concrete block 120.

In this case, the upper insertion guide part 132 of the guide pole 130 is easily inserted into the through hole 121*b* of the second concrete block 120, and guides the seating position of the second concrete block 120.

This process is described in more detail in Korean Patent No. 10-2022339 "CONSTRUCTION METHOD FOR UNDERWATER CONCRETE BLOCK STRUCTURE" (registered on Sep. 10, 2019), which is incorporated by reference in its entirety in the present specification.

As illustrated in FIG. 5, a plurality of second concrete blocks 120 are installed in multiple layers on the top of the first concrete block 110, or in another embodiment (refer to FIG. 15), second concrete blocks 120 may be installed in one layer on the top of the first concrete block 110.

Accordingly, in the concrete block assembly 100A formed by the installation of the second concrete blocks 120, the concrete-column through hole 140 having a closed lower end is formed.

The concrete-column through hole 140 is formed by the through holes 121*b* of the second concrete blocks 120 and the first concrete block 110.

In the concrete block assembly 100A, the first watertight packing 114 is located between the first concrete block body 111 and the second concrete block body 121 and prevents water from being introduced into the concrete-column through hole 140 from the outside.

In the concrete block assembly 100A, the second watertight packing 114 is located between the second concrete block bodies 121 disposed vertically and prevents water from being introduced into the concrete-column through hole 140 from the outside.

That is, in the concrete block assembly 100A, although water exists in the concrete-column through hole 140, there is no water inside the guide pole 130, but there is water only in space outside the guide pole 130. Furthermore, external water cannot be introduced into the concrete-column through hole 140 due to the first watertight packing 114 and the second watertight packing 124.

As illustrated in FIG. 14, at the concrete block assembly 100A, a plurality of first concrete blocks 110 are continuously disposed horizontally, and a plurality of second concrete block 120 are continuously disposed horizontally.

(6) Drainage Step

Figure 6:
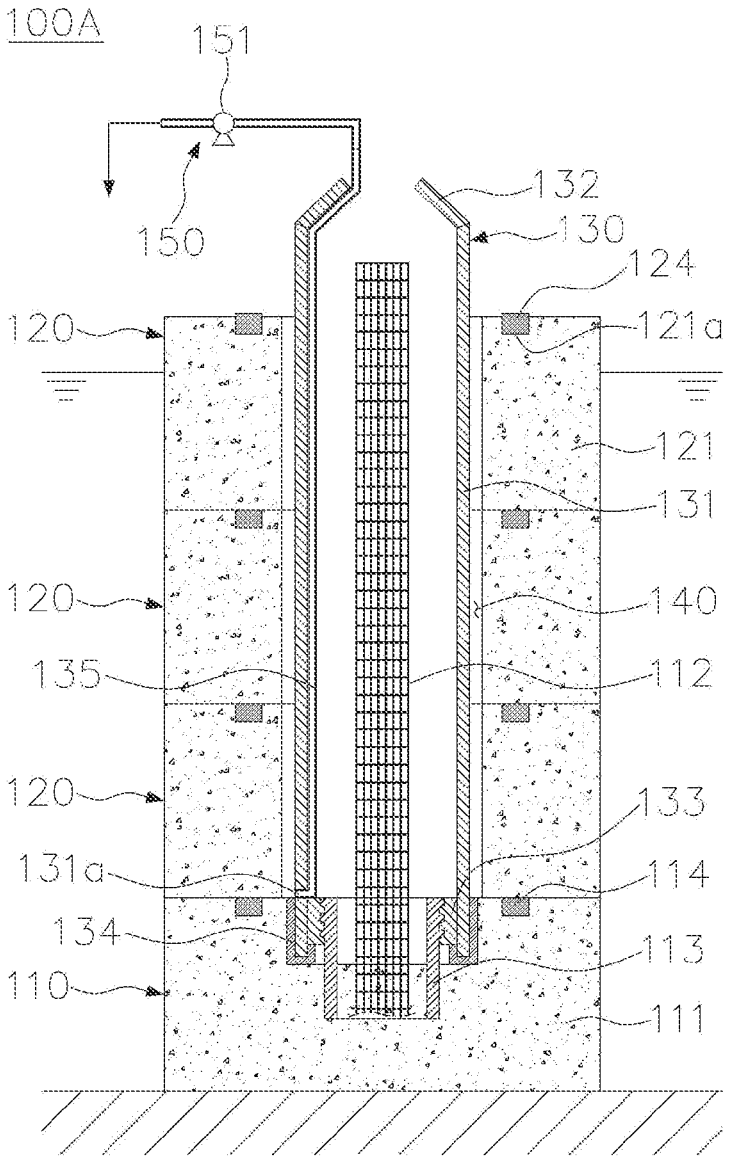

After the second concrete block installation step, as illustrated in FIG. 6, a drainage step is performed to remove water inside the concrete-column through hole 140.

To this end, a drainage device 150 including a drain pump 151 is connected to the upper end of the drain pipe 135, and due to the operation of the drain pump 151, water contained inside the concrete-column through hole 140 is discharged through the drain pipe 135 and the drainage device 150 to the outside.

Meanwhile, water cannot flow into the concrete-column through hole 140 from the outside due to the first watertight packing 114 and the second watertight packing 124, and thus due to this step, the concrete-column through hole 140 becomes dry.

In this embodiment, inside the concrete-column through hole 140, only water in space outside the guide pole 130 is drained, so draining time is greatly reduced.

Depending on an embodiment, there may be a case in which the guide pole 130 is not used. In this case, there is the inconvenience of inserting the drain hose up to the lower part of the concrete-column through hole 140, and further, since the inside of the concrete-column through hole 140 is full of water, it takes a relatively long time to drain the water.

(7) Guide Pole Removal Step

Figure 7:
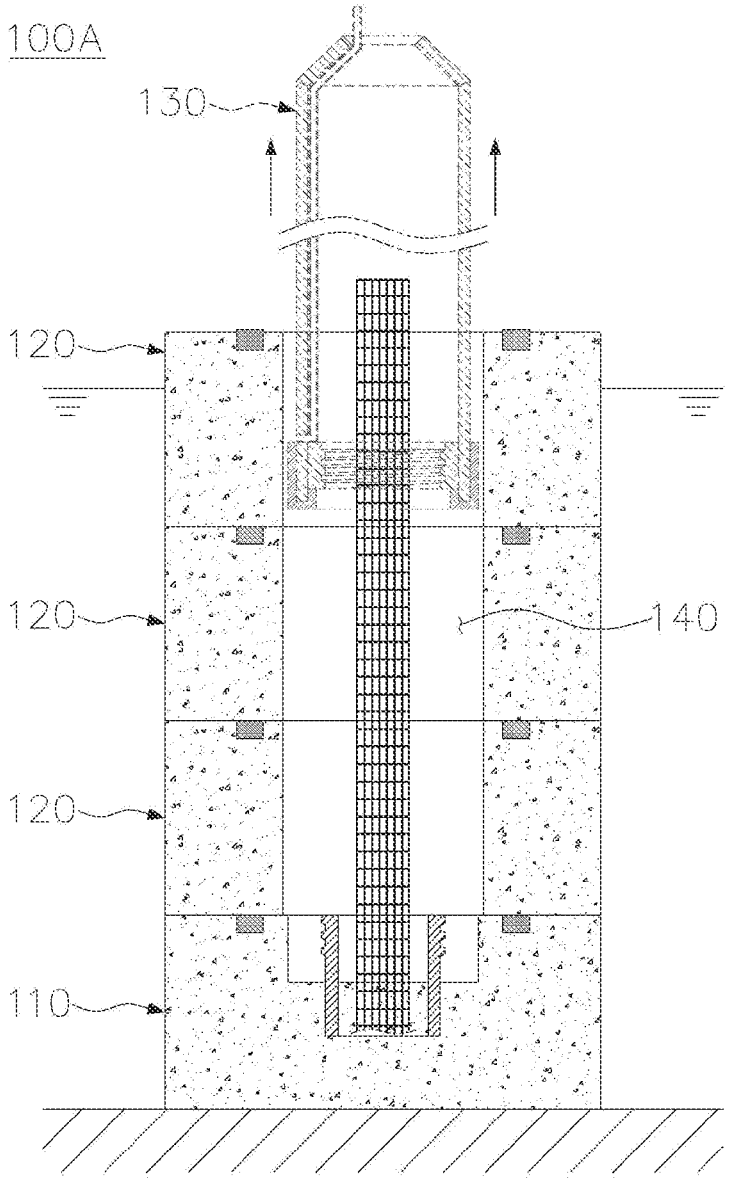

After the drainage step, as illustrated in FIG. 7, a guide pole removal step is preformed to remove the guide pole 130.

The guide pole 130 is rotated so that the screw coupling of the pipe-side coupler 133 to the block-side coupler 113 is released, and the guide pole 130 is moved upward to be removed.

(8) Concrete Column Formation Step

After the guide pole removal step, as illustrated in FIG. 8, concrete 161 is poured into the concrete-column through hole 140, and the concrete column 160 formed such that the column rebar assembly 112 and the poured concrete 161 are integrated with each other is formed in the concrete-column through hole 140.

In this case, there is no water in the concrete-column through hole 140, and there is no risk of leakage of the poured concrete to the outside due to the first watertight packing 114 and the second watertight packing 124, and thus a separate waterproof membrane is not required.

That is, the pouring of the concrete 161 can be performed in the same environment as on land.

Meanwhile, the upper end part of the column rebar assembly 112 does not form the concrete column 160 and protrudes from the top of the concrete column 160.

That is, the column rebar assembly 112 of the first concrete block 110 has a length to pass through the concrete-column through hole 140 and protrude from the top of the concrete-column through hole 140.

(9) Cap Concrete Formation Step

After the concrete column formation step, as illustrated in FIG. 9, a cap concrete 170 is formed on the top of the concrete block assembly 100A and thus the underwater concrete block structure 100B is completed.

In this case, the upper end part of the column rebar assembly 112 which protrudes upward from the upper surface of the concrete-column through hole 140 is connected to the inner reinforcing bar of the cap concrete 170.

In the underwater concrete block structure 100B manufactured as described above, the lower end part of the column rebar assembly 112 is connected to the first concrete block 110, and the upper end part of the column rebar assembly 112 is connected to the cap concrete 170, so the underwater concrete block structure 100B has a very firm structure.

That is, the concrete column 160, the first concrete block 110, and the cap concrete 170 may be integrally formed by the column rebar assembly 112.

Next, an underwater concrete block structure according to a second embodiment of the present disclosure will be described.

Figure 15:
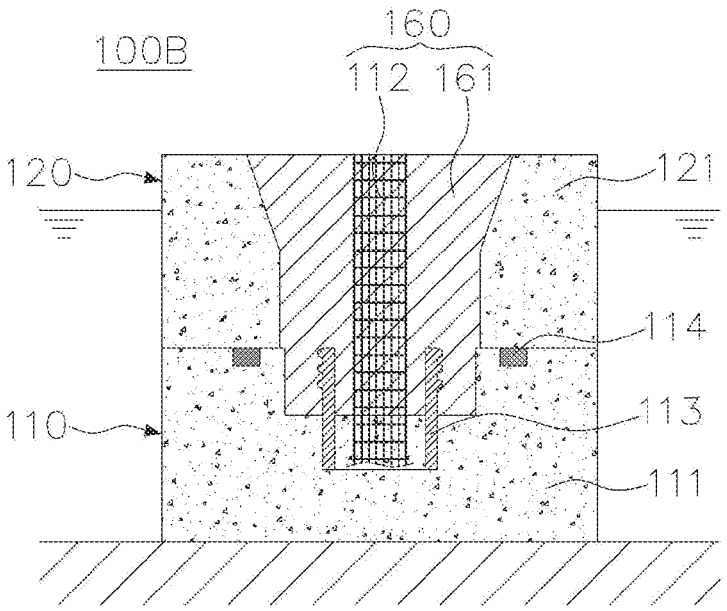
FIG. 15 is a sectional view of an underwater concrete block structure according to a second embodiment of the present disclosure.

FIG. 15 is a sectional view of an underwater concrete block structure according to a second embodiment of the present disclosure.

This embodiment shows that the second concrete blocks 120 may be installed in one layer on the first concrete block 110, not in multiple layers.

In this embodiment, a cap concrete is not formed.

Due to the shape of the through hole 121*b* of the second concrete block 120, an upper end part of the concrete column 160 has a form of wide top and narrow bottom, and the upper end part of the concrete column 160 certainly prevents the second concrete block 120 from escaping upward.

Next, an underwater concrete block structure according to a third embodiment of the present disclosure will be described.

Figure 16:
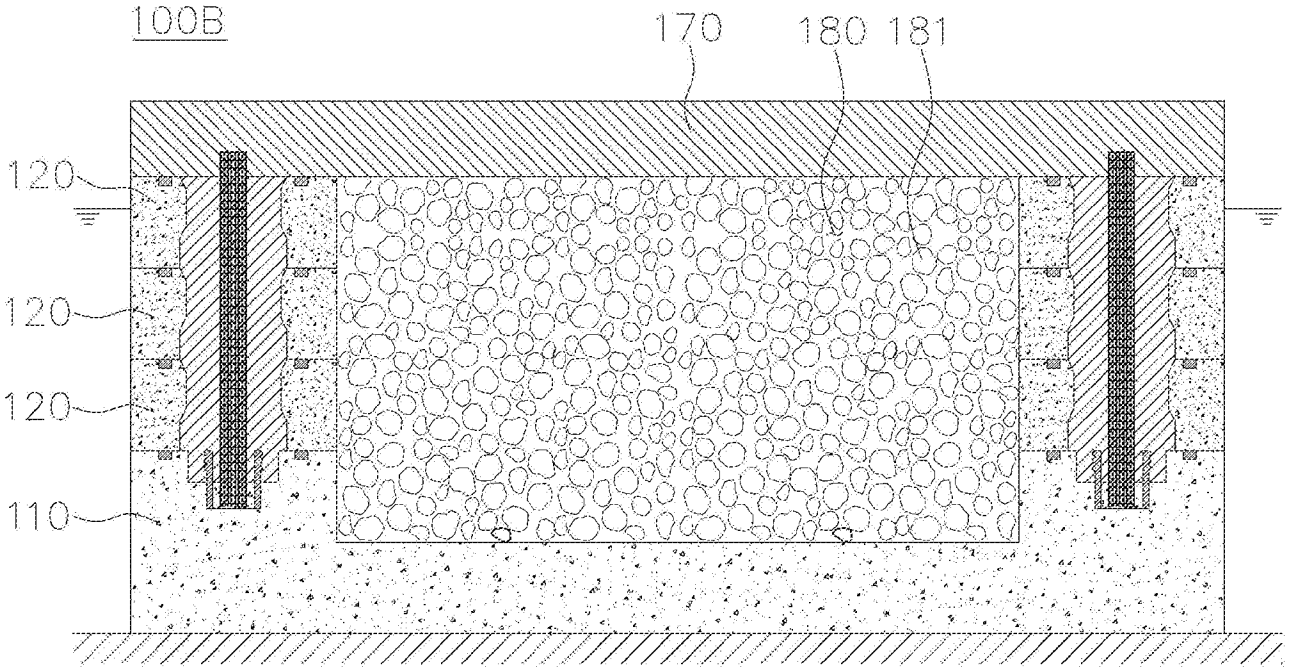
FIG. 16 is a sectional view of an underwater concrete block structure according to a third embodiment of the present disclosure.

FIG. 16 is a sectional view of an underwater concrete block structure according to a third embodiment of the present disclosure.

In this embodiment, when the second concrete block 120 is installed on both sides of the first concrete block 110 to form a concrete block assembly, a space 180 for filling is formed inside the concrete block assembly.

After the second concrete block installation step, a filling step is performed to fill a filling material 181 (sand, gravel, or riprap, etc.) in the space 180 for filling.

After the filling step, the concrete column 160 is formed and the cap concrete 170 is formed.

Next, an underwater concrete block structure according to a fourth embodiment of the present disclosure will be described.

Figure 17:
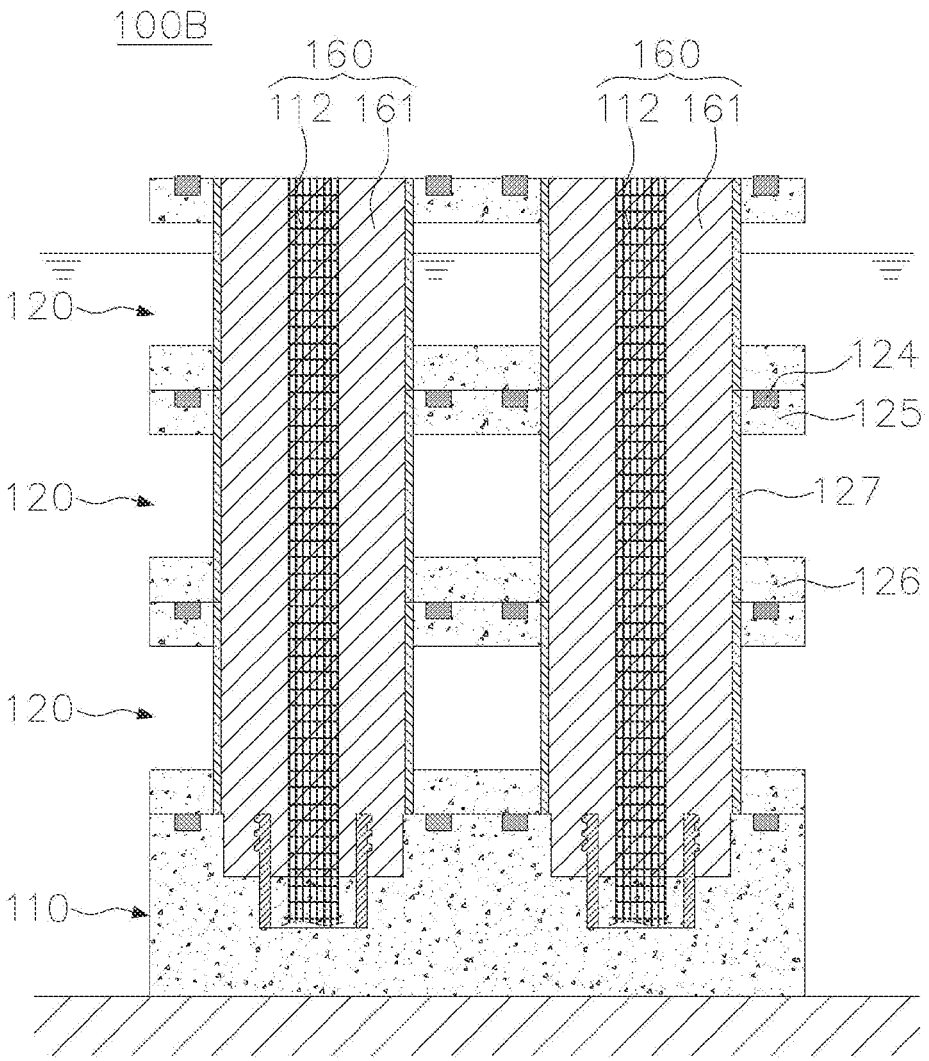
FIG. 17 is a sectional view of an underwater concrete block structure according to a fourth embodiment of the present disclosure.
Figure 18:
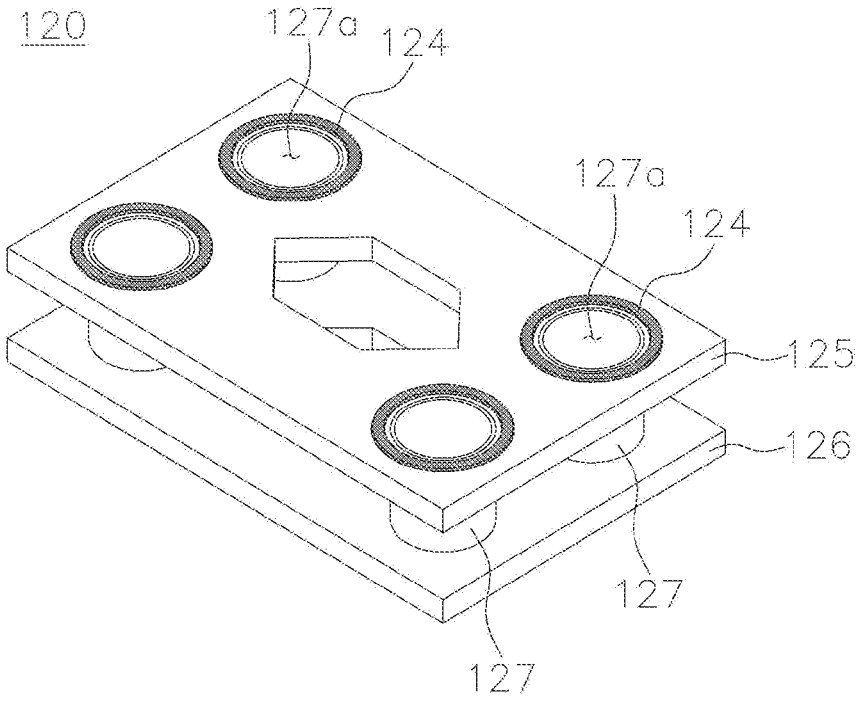
FIG. 18 is a perspective view of a second concrete block in FIG. 17.
Figure 19:
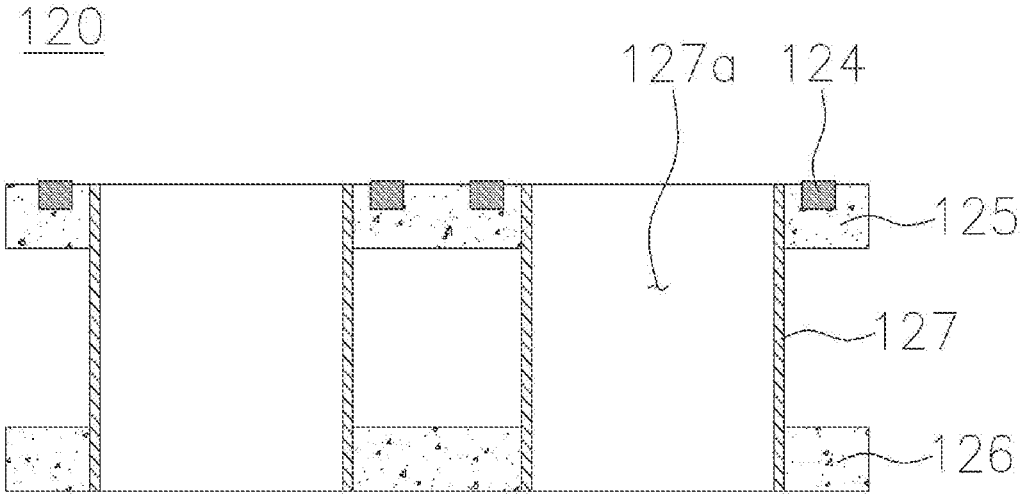
FIG. 19 is a sectional view of FIG. 18.

FIG. 17 is a sectional view of an underwater concrete block structure according to a fourth embodiment of the present disclosure, FIG. 18 is a perspective view of a second concrete block in FIG. 17, and FIG. 19 is a sectional view of FIG. 18.

As illustrated in FIGS. 18 and 19, a second concrete block body of the second concrete block 120 according to this embodiment includes an upper concrete plate 125, a lower concrete plate 126, and a vertical connection pipe 127.

The upper and lower concrete plates 125 and 126 are spaced apart from each other in the vertical direction so that seawater may flow therebetween.

A second watertight packing 124 is provided on the upper concrete plate 125.

An upper and lower parts of the vertical connection pipe 127 are respectively connected to the upper and lower concrete plates 125 and 126 so that a middle part of the vertical connection pipe is exposed to the outside between the upper and lower concrete plates 125 and 126.

In addition, the vertical connection pipe 127 is a hollow pipe having a through hole 127*a* therein.

The underwater concrete block structure 100B as shown in FIG. 17 is formed by using the second concrete blocks 120.

In FIG. 17, a concrete column 160 is continuously formed vertically along the vertical through holes 127*a* of the vertical connection pipes 127.

In such an underwater concrete block structure 100B of the present embodiment, an environment in which seawater can flow freely in the underwater concrete block structure is provided.

That is, the seawater can flow freely around the vertical connection pipes 127, and the concrete columns 160 are internally formed through the vertical connection pipes 127 so that the underwater concrete block structure 100B has a very tightly bound structure.

The above description of the present disclosure is only for illustrative purposes, and those skilled in the art will appreciate that various modifications are possible without departing from the scope and spirit of the present disclosure. Therefore, it should be understood that the embodiments described above are illustrative in all respects and not limiting. For example, each component described as a single type may be implemented in a distributed manner, and similarly, components described as being distributed may also be implemented in a combined form.

The scope of the present disclosure is indicated by the claims to be described later rather than the detailed description, and it should be interpreted that all changes or modified forms derived from the meaning and scope of the claims and concept equivalent thereto are included in the scope of the present disclosure.

The present disclosure may be used to construct an underwater concrete block structure installed at sea or in a river for various purposes such as docks for a port, coastal wave absorbing revetment or breakwater, etc.

The invention claimed is:

1. A method of constructing an underwater concrete block structure, the method comprising:

a first concrete block fabrication step of fabricating a first concrete block comprising a first concrete block body, a column rebar assembly which extends vertically upward from a lower end part of the column rebar assembly connected to an inside of the first concrete block body and protrudes upward from an upper surface of the first concrete block body, and a first watertight packing disposed on the upper surface of the first concrete block body in a form surrounding the column rebar assembly;

a guide pole installation step of installing a guide pole on the first concrete block after the first concrete block fabrication step, wherein the guide pole comprises a guide pipe extending vertically to insert the column rebar assembly along an inside of the guide pipe and an upper insertion guide part formed at an upper end of the guide pipe and having an upwardly tapered shape;

a first concrete block installation step of installing the first concrete block underwater after the guide pole installation step;

a second concrete block fabrication step of fabricating a second concrete block comprising a second concrete block body having a through hole extending vertically;

a second concrete block installation step of installing the second concrete block such that a concrete block assembly is formed by installing the second concrete block on the first concrete block so that the guide pole is inserted into the through hole of the second concrete block after the second concrete block fabrication step and the first concrete block installation step, wherein a concrete-column through hole having a closed lower end is formed in the concrete block assembly by the through hole of the second concrete block and the first concrete block, and the first watertight packing is located between the first concrete block and the second concrete block to prevent water from being introduced from an outside of the concrete block assembly into the concrete-column through hole;

a drainage step of removing water contained inside the concrete-column through hole after the second concrete block installation step;

a guide pole removal step of removing the guide pole after the drainage step; and a concrete column formation step of forming a concrete column by pouring concrete into the concrete-column through hole after the drainage step, wherein the concrete column comprises the column rebar assembly and the poured concrete integrated with each other and is coupled to the first concrete block body via the column rebar assembly.

2. The method of claim 1, wherein the column rebar assembly has a length to pass through the concrete-column through hole and protrudes from a top of the concrete-column through hole, and a cap concrete formation step of forming a cap concrete on the concrete block assembly after the concrete column formation step so that an upper end of the column rebar assembly is connected to an inside of the cap concrete is comprised.

3. The method of claim 1, wherein a block-side coupler is provided in the first concrete block body in a form surrounding the column rebar assembly, the guide pole comprises a pipe-side coupler at a lower end part of the guide pipe to be coupled detachably to the block-side coupler and a third watertight packing provided on a lower end part of the guide pipe to prevent water from being introduced from the outside of the concrete block assembly into the inside of the guide pipe by being in close contact with the first concrete block, and at the guide pole installation step, the pipe-side coupler of the guide pole is coupled detachably to the block-side coupler of the first concrete block.

4. The method of claim 3, wherein a drain pipe of which a lower end communicates with an outside of the guide pipe through a drain hole formed in a lower end part of the guide pipe extends vertically inside the guide pole, the water contained inside the concrete-column hole is removed using the drain pipe at the drainage step, and the guide pole removal step is performed after the drainage step.

5. The method of claim 1, wherein a second watertight packing is disposed on an upper surface of the second concrete block body in a form surrounding the through hole of the second concrete block body; and at the second concrete block installation step, a plurality of second concrete blocks are installed in multiple layers on the first concrete block, and the second watertight packing is located between the second concrete blocks installed to be vertically adjacent to each other so that water is prevented from being introduced from the outside of the concrete block assembly into the concrete-column through hole.

* * * * *